US012686469B2

(12) United States Patent
Anastasia

(10) Patent No.: US 12,686,469 B2
(45) Date of Patent: Jul. 21, 2026

(54) MODULAR INFLATABLE ENTERTAINMENT VENUE

(71) Applicant: Mark R Anastasia, Orlando, FL (US)

(72) Inventor: Mark R Anastasia, Orlando, FL (US)

( * ) Notice: Subject to any disclaimer, the term of this patent is extended or adjusted under 35 U.S.C. 154(b) by 439 days.

(21) Appl. No.: 18/209,950

(22) Filed: Jun. 14, 2023

(65) Prior Publication Data

US 2024/0158049 A1 May 16, 2024

Related U.S. Application Data

(60) Provisional application No. 63/352,209, filed on Jun. 14, 2022.

(51) Int. Cl.

| | |
|---|---|
| ***B63B 7/08*** | (2020.01) |
| ***B63B 17/02*** | (2006.01) |
| ***B63B 21/50*** | (2006.01) |
| ***B63B 29/04*** | (2006.01) |

(52) U.S. Cl.

CPC ..... *B63B 7/082* (2013.01); *B63B 7/085* (2013.01); *B63B 17/02* (2013.01); *B63B 21/50* (2013.01); *B63B 29/04* (2013.01); *B63B 2029/043* (2013.01); *B63B 2029/046* (2013.01)

(58) Field of Classification Search

CPC ... B63B 29/00; B63B 29/04; B63B 2029/043; B63B 2029/046; B63B 7/00; B63B 2007/003; B63B 2007/006; B63B 2007/065; B63B 7/04; B63B 7/06; B63B 7/08; B63B 7/082; B63B 7/085; B63B 35/00; B63B 2035/004; B63B 35/58; B63B 35/607; B63B 35/613; B63B 35/62; B63B 17/00; B63B 17/02; B63B 17/04; B63B 21/50; B63C 9/28; B63C 9/30; A63G 31/00; A63G 31/30

USPC .. 441/129, 130, 136, 35, 40, 43, 44, 45, 47, 441/50; 114/343; 472/128

See application file for complete search history.

(56) References Cited

U.S. PATENT DOCUMENTS

| | | | | |
|---|---|---|---|---|
| 6,749,774 | B2 * | 6/2004 | Takezawa | H01R 4/04 252/514 |
| 6,808,434 | B1 * | 10/2004 | Park | B63B 34/50 441/130 |
| 6,878,026 | B2 * | 4/2005 | Cloutier | B63B 34/50 441/130 |
| 6,971,936 | B2 * | 12/2005 | Le Gette | A47C 15/006 441/130 |
| 7,300,104 | B1 * | 11/2007 | Hagedorn | A47B 37/04 297/158.3 |
| 7,404,371 | B2 * | 7/2008 | Schmitt | B63B 34/52 114/361 |

(Continued)

*Primary Examiner* — Daniel V Venne

(74) *Attorney, Agent, or Firm* — Jon M. Gibbs; Lowndes

(57) ABSTRACT

A modular inflatable entertainment venue for use on a body of water includes a substrate having an upper surface and a lower surface wherein the substrate further comprises at least one air chamber disposed between the upper surface and the lower surface. A pedestal for supporting a removable tabletop, the pedestal having a fastener for attaching the removable tabletop. A removable tabletop removably attached to the pedestal by the fastener. At least one aperture in the substrate defining a sitting area and a netted footwell removably attached about the periphery of the aperture and extending downward into the water.

20 Claims, 12 Drawing Sheets

(56) References Cited

U.S. PATENT DOCUMENTS

| | | | | |
|---|---|---|---|---|
| 11,148,765 | B2 * | 10/2021 | Pieschel | B63B 34/54 |
| 12,421,752 | B2 * | 9/2025 | Bogue | A63G 31/12 |

* cited by examiner

MODULAR INFLATABLE ENTERTAINMENT VENUE

CROSS-REFERENCE TO RELATED APPLICATIONS

This application claims priority to U.S. Provisional Patent Application Ser. No. 63/352,209, filed Jun. 14, 2022.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR A JOINT INVENTOR

Not applicable.

BACKGROUND OF THE INVENTION

Field of Invention

The present disclosure generally relates to; inflatable aquatic devices and more specifically, to modular inflatable entertainment venues.

Description of Related Art

Docks, boats, and yachts are limited in the surface area in which people may gather. The present invention comprises an inflatable entertainment venue for anchoring or connecting to a dock or floating vessel to provide additional surface area upon which people may congregate. The inflatable entertainment venue disclosed herein is modular in that there are a number of options which may be attached to the venue when in use.

Any documents or publications cited in this disclosure are incorporated by reference in their entirety, to the extent they are not inconsistent with the explicit teachings set forth herein.

BRIEF SUMMARY OF THE INVENTION

A modular inflatable entertainment venue for use on a body of water includes a substrate having an upper surface and a lower surface wherein the substrate further includes at least one air chamber disposed between the upper surface and the lower surface. A pedestal connected to the substrate for supporting a removable tabletop, the pedestal including a fastener for attaching the removable tabletop. A removable tabletop removably attached to the pedestal by the fastener. At least one aperture in the substrate defining a sitting area.

A netted footwell removably attached about the periphery of the at least one aperture and extending downward into the water.

Aspects of the present invention include a fastener on the pedestal comprising hook and loop fasteners.

Aspects of the present invention further include the netted footwell being connected to the venue by hook and loop fasteners.

Aspects of the present invention further include a channel molded into the substrate.

Aspects of the present invention further include a set of steps is disposed in the channel for ingress and egress to the venue.

Aspects of the present invention further include a back rest further defining a sitting area adjacent the aperture.

Aspects of the present invention further include body fasteners attached to the substrate for connecting to another modular inflatable apparatus.

Aspects of the present invention further include a connection flap for connecting to a gap cap cover between the venue and another modular inflatable apparatus.

Aspects of the present invention further include cover fasteners for attaching a removable cover.

Aspects of the present invention further include a removable cover.

Aspects of the present invention further include a removable tabletop further comprises wells for holding food and/or drinks.

Aspects of the present invention further include ballast bags attached to the lower surface of the substrate.

Aspects of the present invention include different types of table top removably attached to the pedestal.

Additional aspects of the present invention include the use of D-rings, retaining clips, hook and loop fasteners and other devices for securing the modular inflatable entertainment venue to anchors, docks, boats, yachts or other floating structures.

Further aspects of the present invention include the use of a removable cover over the seating area for providing additional protection to the users while providing a more aesthetic look.

Further objects and advantages of the present invention will become apparent by reference to the following detailed disclosure of the invention and appended drawings wherein like reference numerals refer to the same feature, component or element.

DETAILED DISCLOSURE OF THE INVENTION

Figure 1:
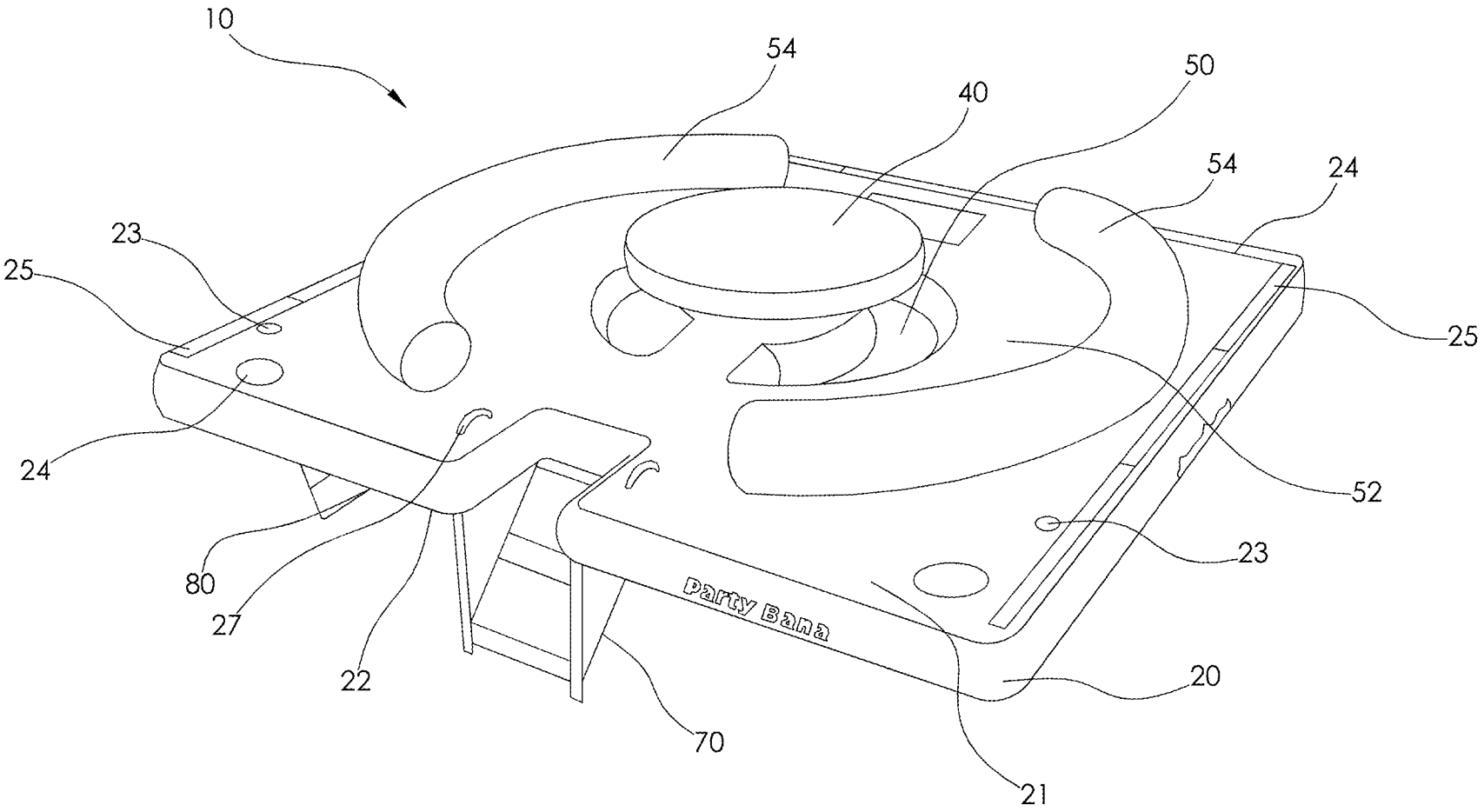
FIG. 1 is a perspective view showing a modular inflatable entertainment venue according to aspects of the present invention with the removable tabletop attached.
Figure 2:
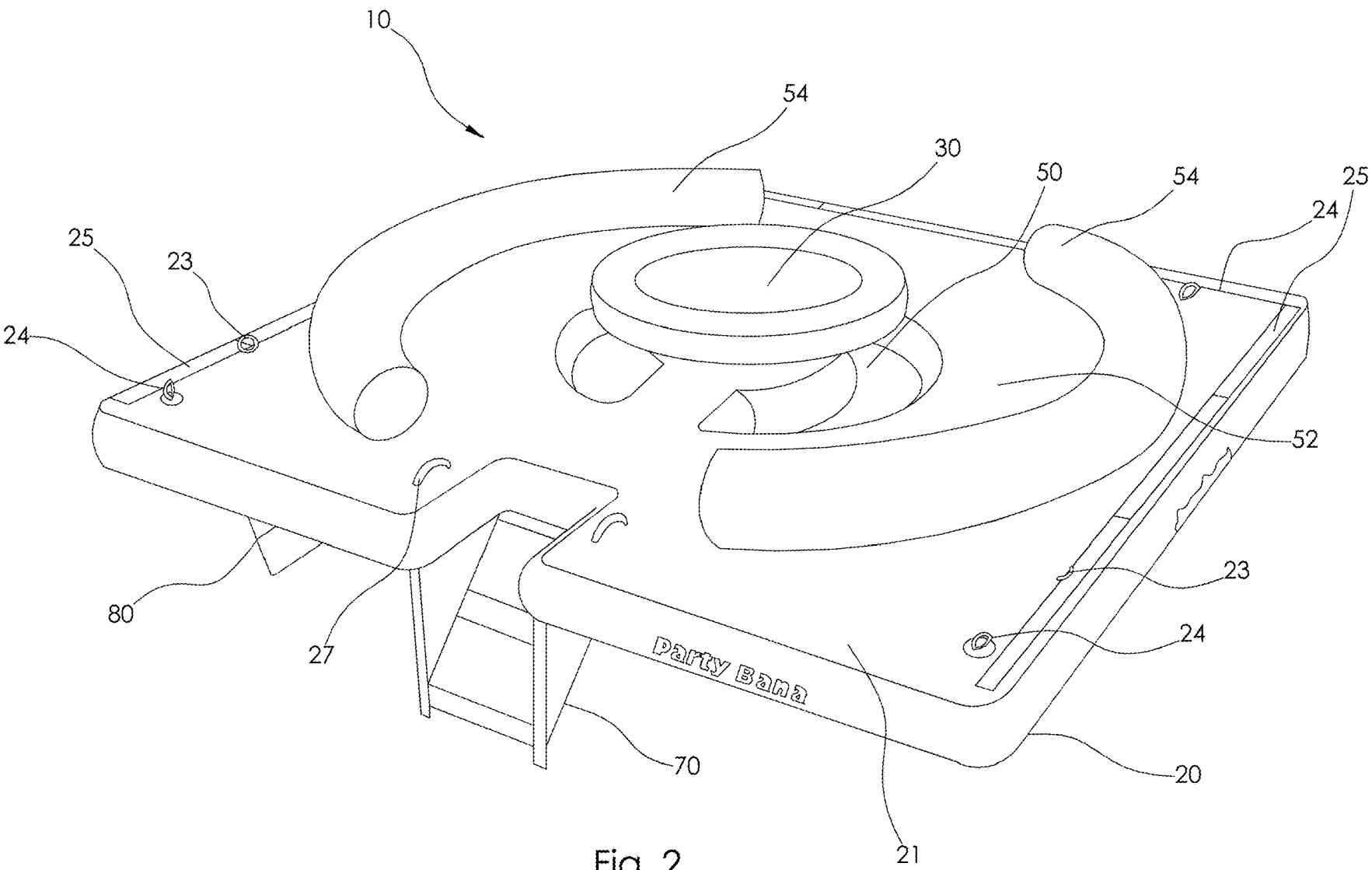
FIG. 2 is a perspective view showing a modular inflatable entertainment venue to aspects of the present invention without the removable tabletop attached according.
Figure 3:
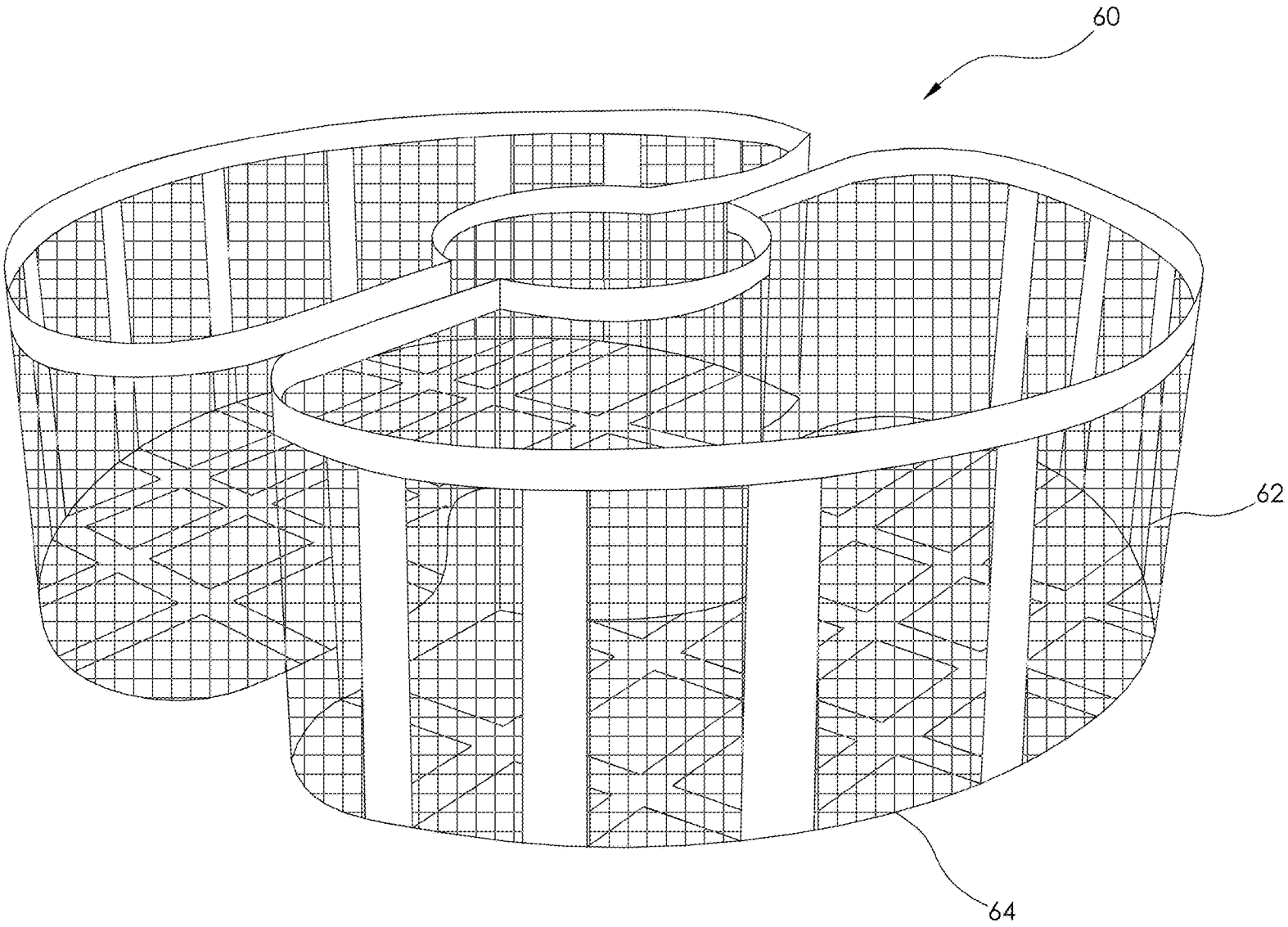
FIG. 3 is a perspective view showing the netted footwell of a modular inflatable entertainment venue according to aspects of the present invention.
Figure 4:
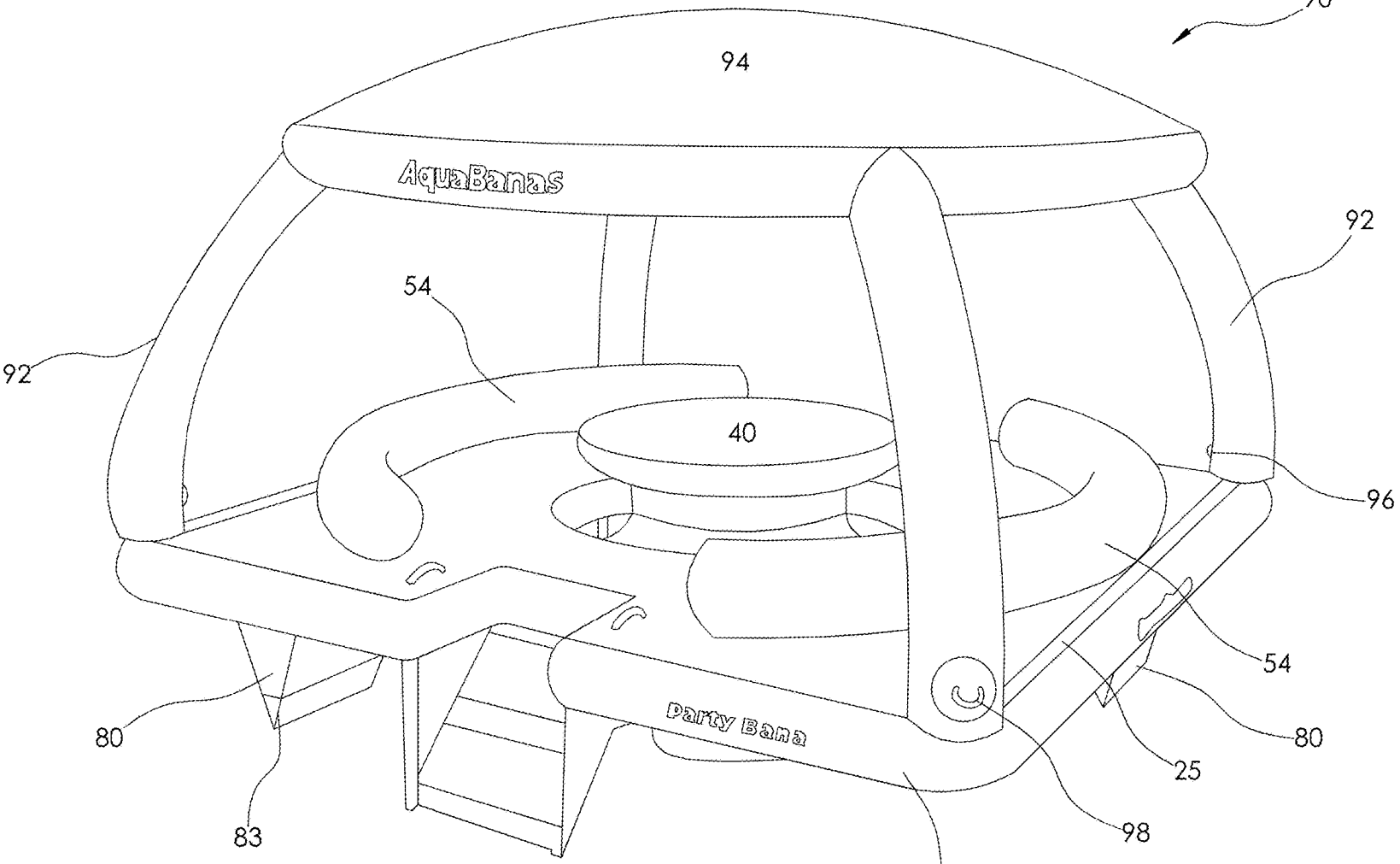
FIG. 4 is a perspective view showing a modular inflatable entertainment venue with cover attached according to aspects of the present invention.
Figure 5:
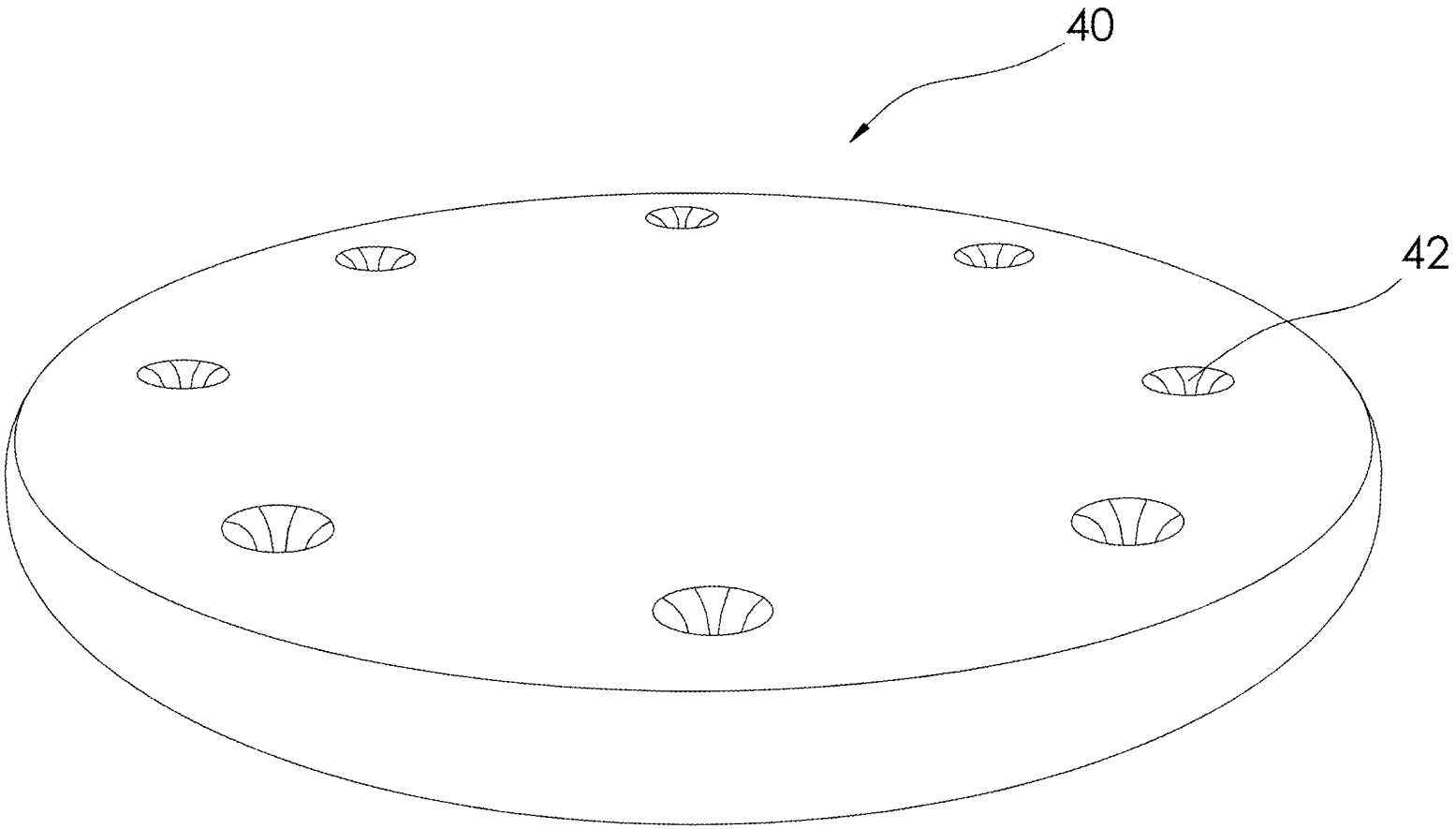
FIG. 5 is a perspective view showing an alternative embodiment of a removable tabletop of a modular inflatable entertainment venue according to aspects of the present invention.
Figure 6:
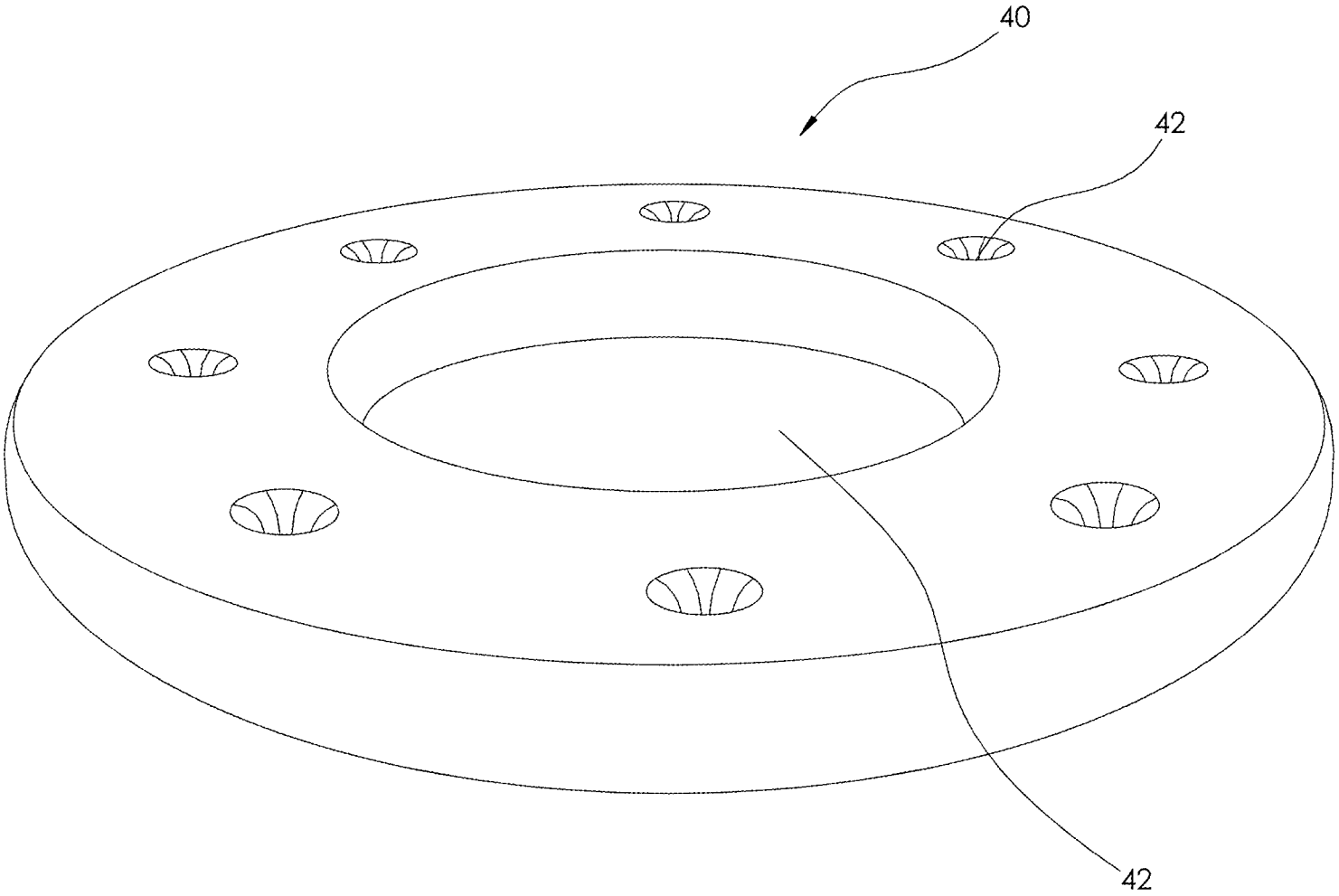
FIG. 6 is a perspective view showing an alternative embodiment of a removable tabletop of a modular inflatable entertainment venue according to aspects of the present invention.
Figure 7:
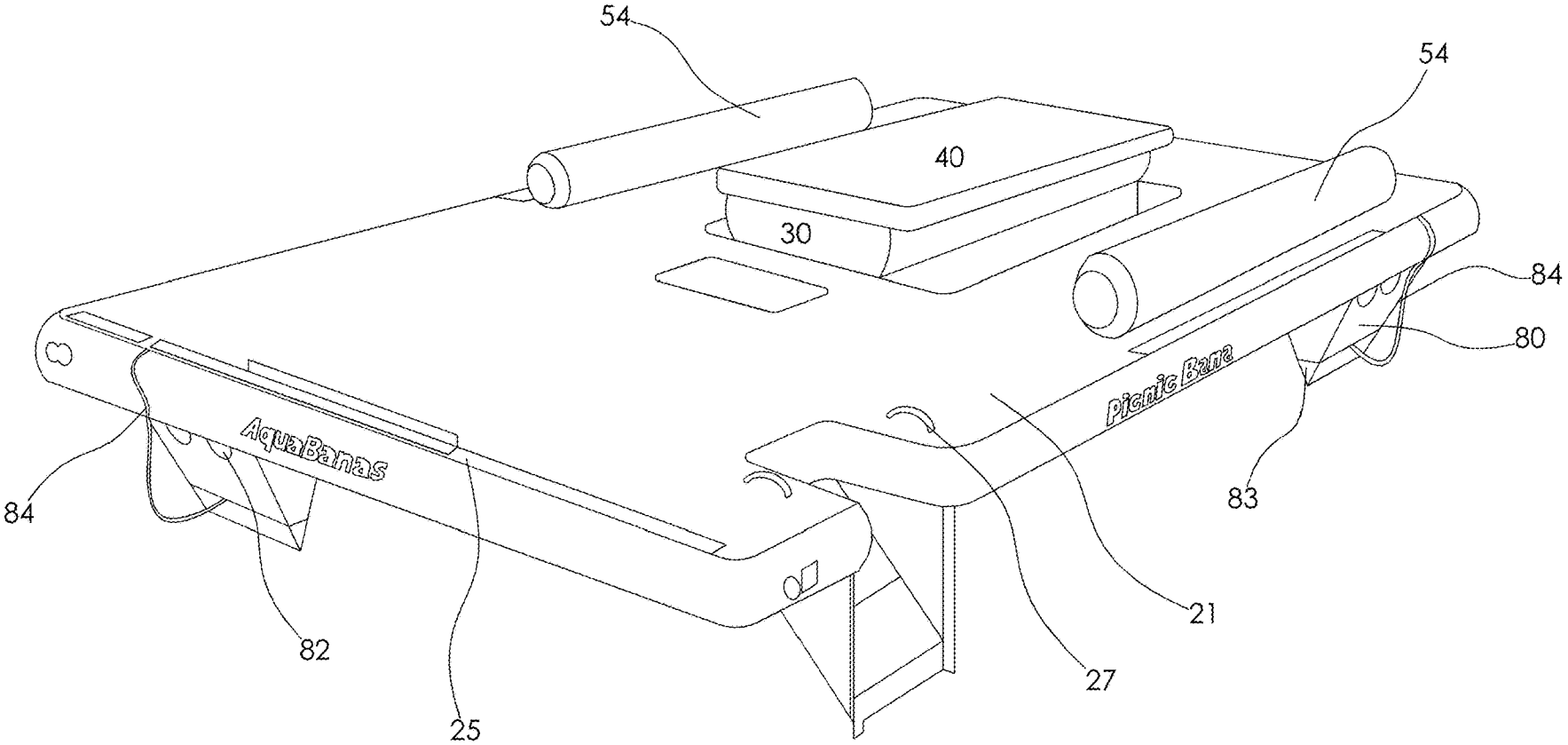
FIG. 7 is a perspective view showing an alternative embodiment of a modular inflatable entertainment venue according to aspects of the present invention.
Figure 8:
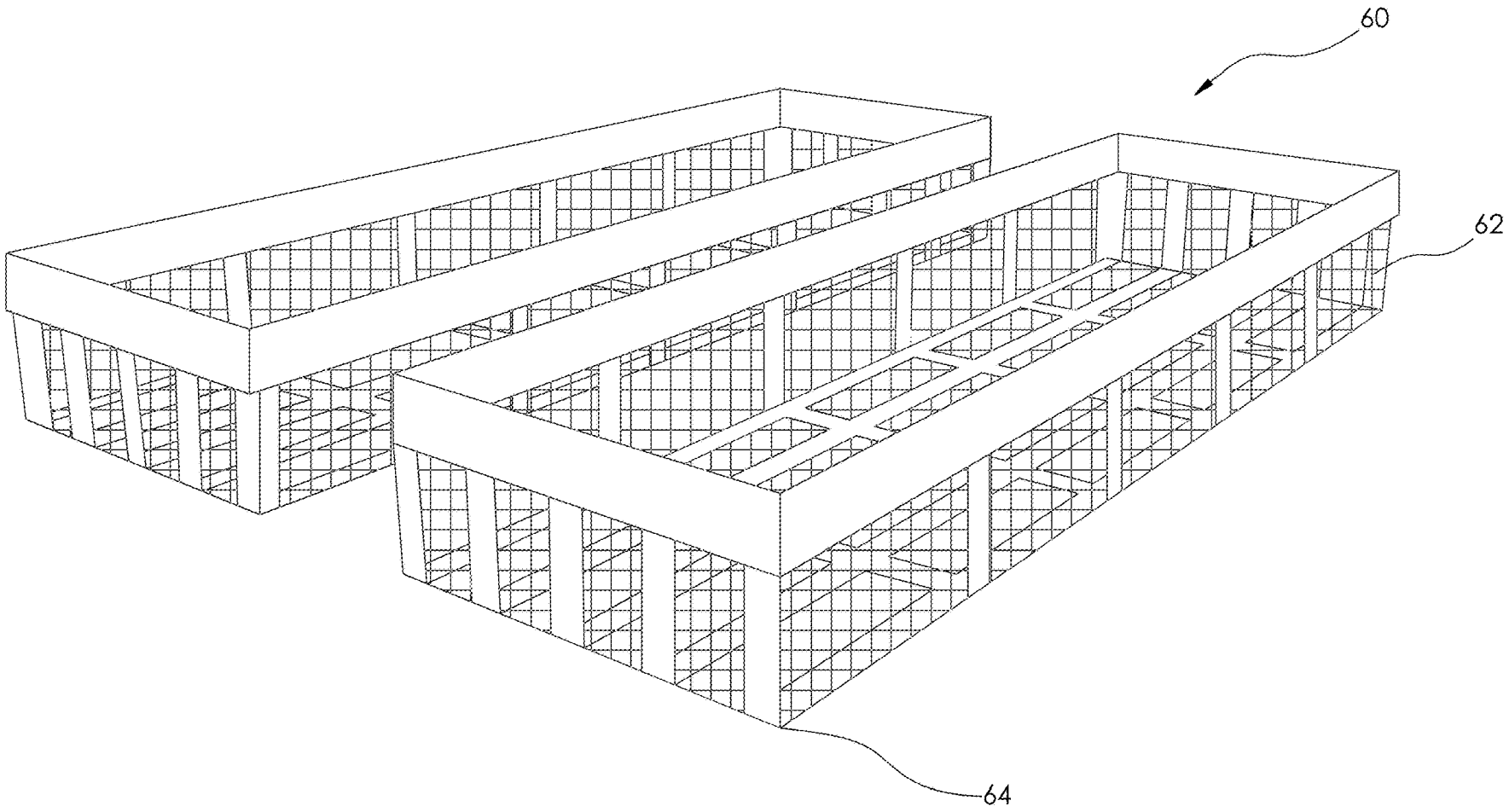
FIG. 8 is a perspective view showing an alternative embodiment of a netted footwell of a modular inflatable entertainment venue according to aspects of the present invention.
Figure 9:
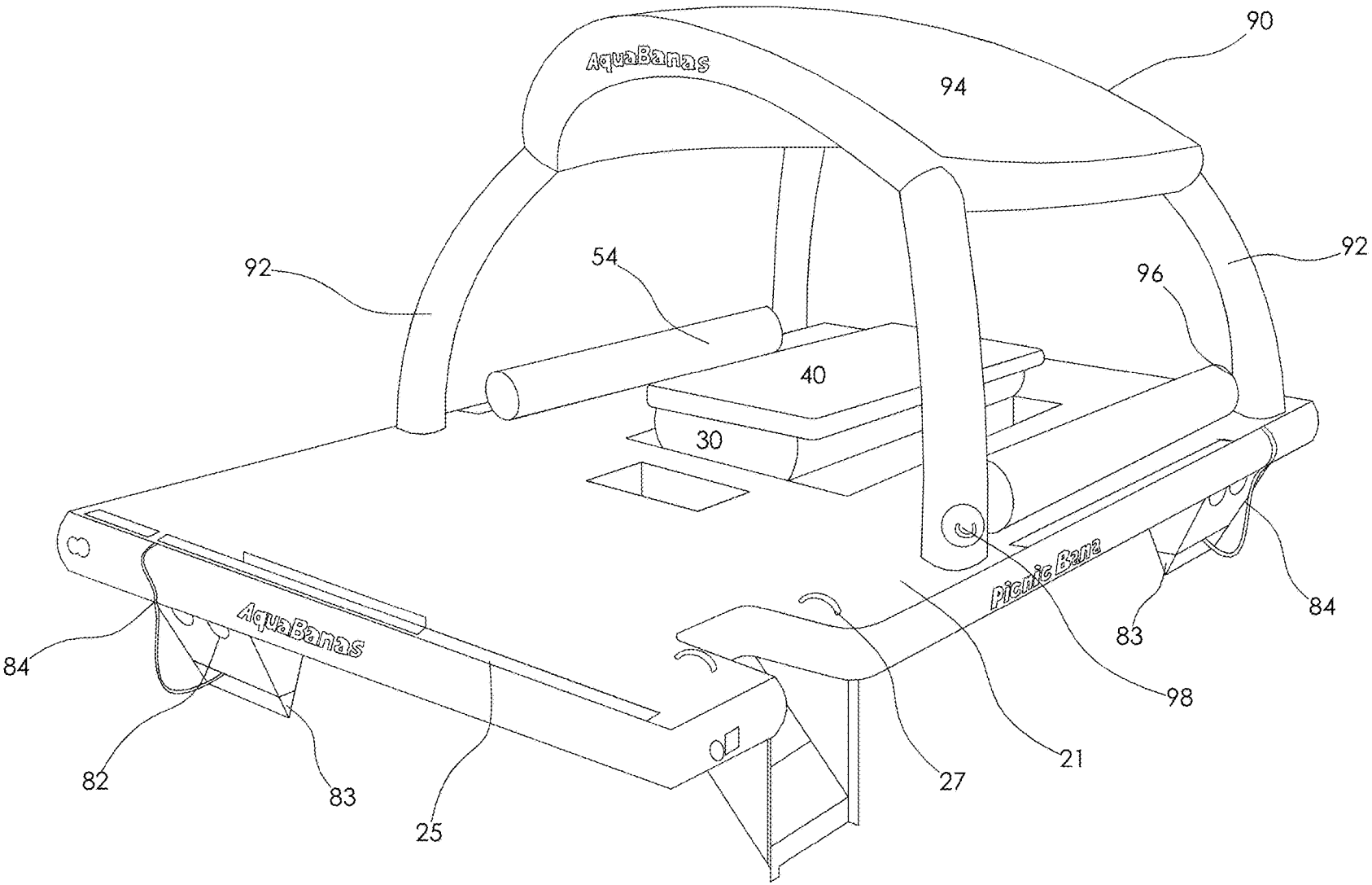
FIG. 9 is a perspective view showing an alternative embodiment of a modular inflatable entertainment venue with cover attached according to aspects of the present invention.
Figure 10:
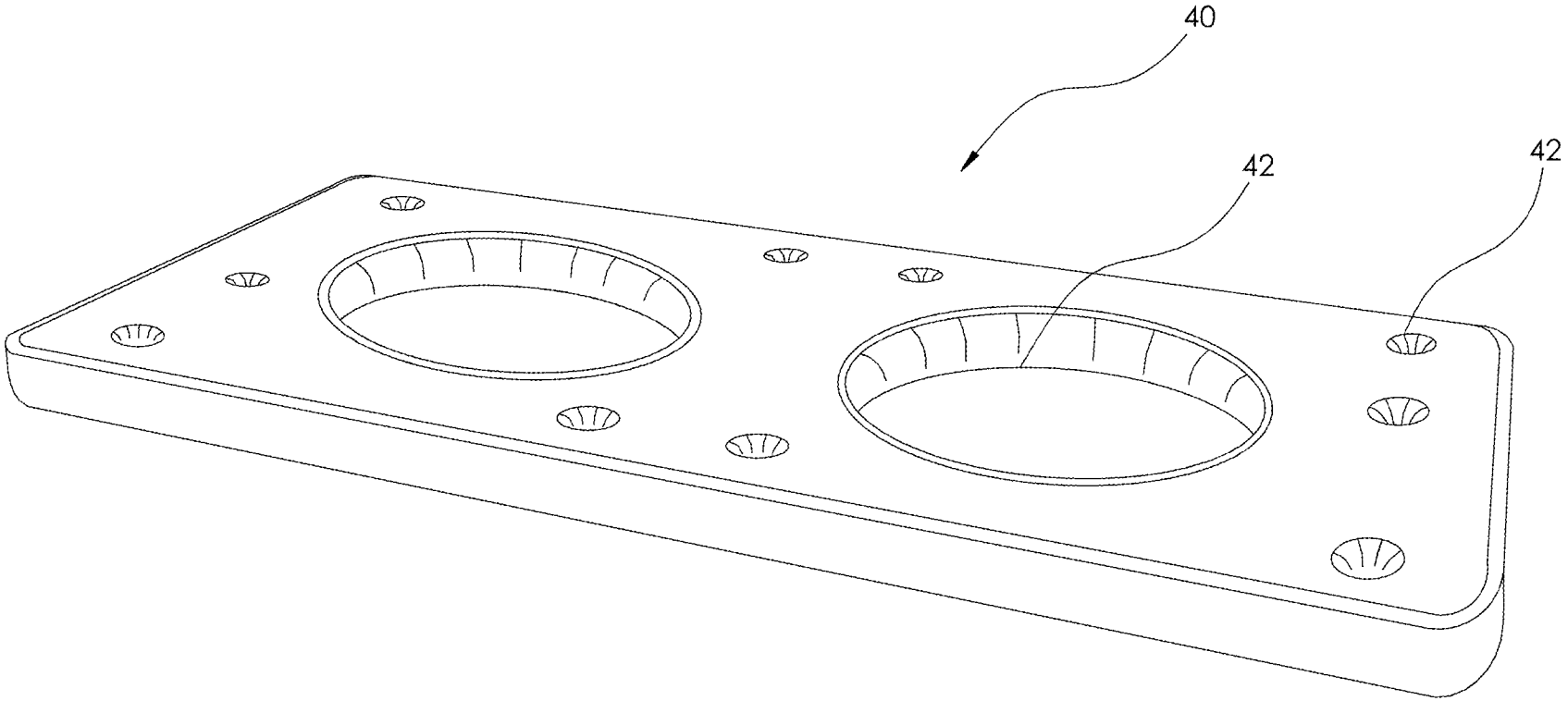
FIG. 10 is a perspective view showing an alternative embodiment of a removable tabletop of a modular inflatable entertainment venue according to aspects of the present invention.
Figure 11:
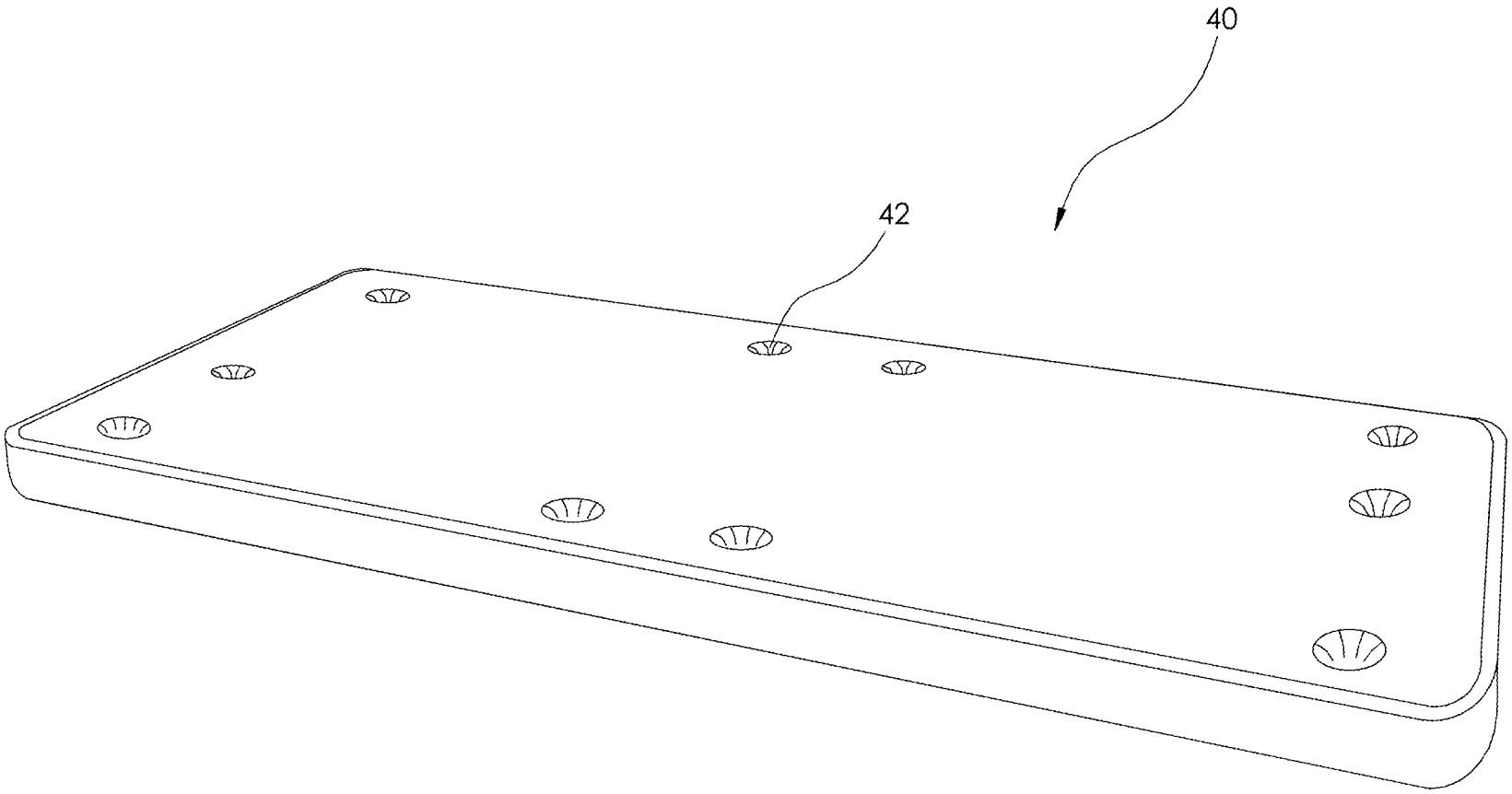
FIG. 11 is a perspective view showing an alternative embodiment of a removable tabletop of a modular inflatable entertainment venue according to aspects of the present invention.
Figure 12:
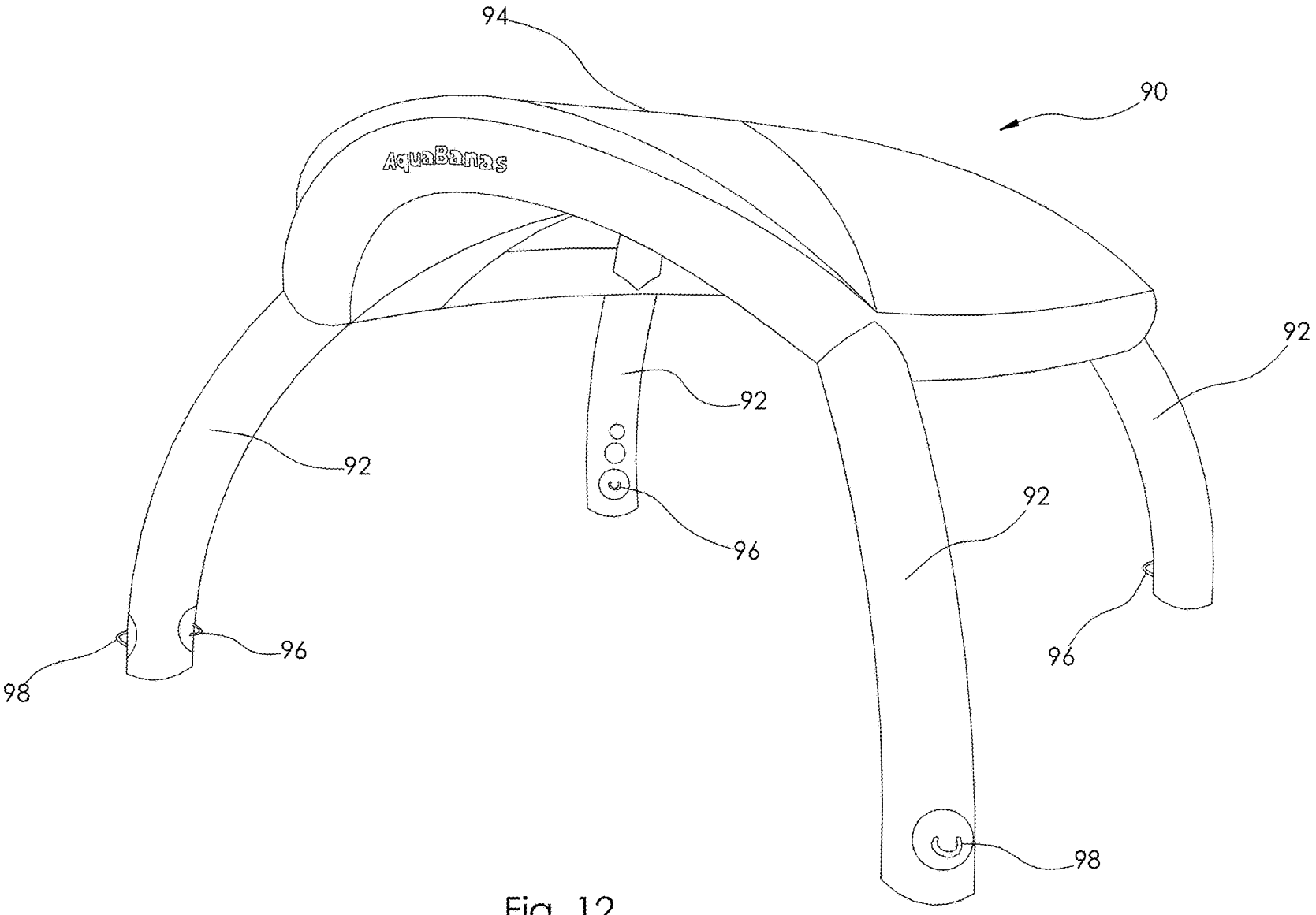
FIG. 12 is a perspective view showing a removable cover of a modular inflatable entertainment venue according to aspects of the present invention.

Referring now to FIGS. 1-12, the modular inflatable entertainment venue disclosed herein is shown and illustrated by reference numeral 10.

The modular inflatable entertainment venue 10 is generally made for use on a body of water (not shown) and includes a substrate 20 having an upper surface 21 and a lower surface 22. The substrate 20 further comprises at least one air chamber (not shown) disposed between the upper surface 21 and the lower surface 22.

The substrate 20 can include at least one aperture 50 through the substrate 20. The aperture 50 can define a sitting area 52 on the substrate wherein users may sit on the substrate 20 and dangle their feet into the water (now shown). An inflatable backrest 54 may further attached to the substrate 20 and further define the sitting area 52 thereby providing support for users.

A pedestal 30 for removably receiving a tabletop 40 may be attached to the substrate in or around the sitting area 52. The tabletop 40 may be attached to the pedestal 30 using hook and loop fasteners, zippers, or any other connection means known in the art. The removable tabletop 40 can include a flat surface tabletop 40 or can include any number or combination of wells 42 for purposes of holding drinks, food, and the like.

The upper surface 21 can include at least one body fastener 23 for attaching the venue 10 to another modular inflatable apparatus, anchor, dock, vessel, or any other apparatus to which fastening is desired. Body fasteners 23 can include D-rings, O-rings, straps, cleats, or other connection means as may be known in the art and can be attached to the substrate 20 by hot air welding, high-frequency welding, gluing or any other attachment method known in the art. The body fasteners 23 may be made of metal, polymer, or natural materials.

The upper surface 21 can further include cover fasteners 24 for fastening a removable cover 90 to provide shade to users. Cover fasteners 24 can include D-rings, O-rings, straps, cleats, or other connection means as may be known in the art and can be attached to the substrate 20 by hot air welding, high-frequency welding, gluing or any other attachment method known in the art. The cover fasteners 24 may be made of metal, polymer, or natural materials.

The upper surface 21 can further include a connection flap 25 disposed near one or more edges of the substrate 20. The connection flap 25 can be a gator mouth flap as is known in the art comprising hook and loop fasteners for receiving a gap cap cover (not shown) to reduce or eliminate any gap between the substrate 20 and any other modular inflatable apparatus (not shown) to which it is attached. The connection flap 25 can alternatively comprise a zipper or other connection means known in the art.

The upper surface 21 can further include at least one attached handle 26 for convenience in moving the venue 10, or to assist a user with ingress or egress to or from the water, respectively.

The lower surface 22 of the substrate 20 can include at least one ballast bag 80 to assist in maintaining the stability and position of the venue 10. A ballast bag 80 can include at least one aperture 82 near the top of the ballast bag for allowing water into the ballast bag 80. When the ballast bag 80 fills with water, the weight of the water, coupled with the profile of the ballast bag 80 assists in maintaining the stability of the venue by providing weight and drag in the water. Preferably the ballast bag 80 will further include smaller apertures 83 near the bottom of the ballast bag 80 to allow for the escape of water when the ballast bag 80 is collapsed or the venue 10 is removed from the water. A closing strap 84 can be connected from the bottom of the ballast bag 80 to the upper surface 21 of the substrate 20 to selectively collapse the ballast bag 80. Collapsing the ballast bag 80 can allow for easier repositioning or towing of the venue 10 through the water.

The lower surface 22 of the substrate 20 can further include tow rings (not shown). Tow rings (not shown) can include D-rings, O-rings, straps, cleats, or other connection means as may be known in the art and can be attached to the substrate 20 by hot air welding, high-frequency welding, gluing or any other attachment method known in the art. The tow rings (not shown) may be made of metal, polymer, or natural materials. A towing bridle (not shown) may be attached to the tow rings (not shown) and further attached to a towing means, such as a boat, personal watercraft, or other vessel to tow the venue 10 through the water when necessary.

The substrate 20 can further include a channel 72 for including a quick access step 70 attached to the lower surface 22 of the substrate 20. The quick access step 70 can be used for ingress and egress to and from the venue into the water. The channel 72 can be disposed on any side of the substrate 20, but preferably along a side that does not include a connection flap 25. The quick access steps 70 may be attached to the lower surface 22 of the substrate 20 using hook and loop fasteners, zippers, or any other connection means known in the art.

At least one handle 27 can be attached to the upper surface 21 of the substrate 20 adjacent the quick access steps 70 to further assist with ingress and egress to the venue 10. The handle 27 can be attached to the substrate 20 by hot air welding, high-frequency welding, gluing or any other attachment method known in the art.

The venue 10 can further include a netted footwell 60 attached to the lower surface 22 of the substrate 20 around the periphery of the aperture. The netted footwell 60 is preferably constructed of a durable netting material comprises at least one sidewall 62 and a bottom 64. The netted footwell 60 can extend down into the water and be entirely enclosed with a netted bottom to provide protection to the users from errant sea life such as jellyfish or other sea life capable of biting or stinging. Alternatively, a netted footwell 60 can comprise solely a sidewall configuration extending into the water with no bottom. The netted footwell 60 may be attached to the lower surface 22 of the substrate 20 using hook and loop fasteners, zippers, or any other connection means known in the art. The position of the netted footwell may be maintained using weights or weighted material at or near the bottom of the sidewall.

The venue 10 can further include an inflatable removable cover 90 which can be attached to the upper surface 21 of the substrate 20 and provide shade to the users. The cover 90 comprises a plurality of substantially vertical supports 92 attached to a canopy 94. Each vertical support 92 can include an inner connection ring 96 and an outer connection ring 98 for connecting the cover 90 to the upper surface 21 of the substrate 20 or anchoring the cover to another modular inflatable apparatus (not shown).

Alternatively, because the cover 90 has sufficient buoyancy and rigidity to stand on its own, the cover 90 may be anchored to the sea floor and allowed to float on the water to provide shade for users. The cover 90 may also be anchored to the ground and used on land. Inner connection ring 96 and an outer connection ring 98 can include D-rings, O-rings, straps, cleats, or other connection means as may be known in the art and can be attached to the vertical supports 92 by hot air welding, high-frequency welding, gluing or any other attachment method known in the art. Inner connection rings 96 and an outer connection rings 98 may be made of metal, polymer, or natural materials.

In general, the venue 10, including all inflatable components of the venue 10 are constructed from poly vinyl chloride (PVC) and are sealed by hot air welding or high-frequency welding. Each inflatable component comprises a valve for inflating and deflating the component. To the extent components are permanently connected to one another, the components are connected by hot air welding, high-frequency welding, gluing or any other attachment method known in the art.

According to aspects of the present invention, the venue can include a myriad of different modular apparatus including different tabletop options and selectively attachable netting.

Inasmuch as the preceding disclosure presents the best mode devised by the invention for practicing the invention and is intended to enable one skilled in the pertinent art to carry it out, it is apparent that methods incorporating modifications and variations will be obvious to those skilled in the art. As such, it should not be construed to be limited thereby but should include such aforementioned obvious variations and be limited only by the spirit and scope of the following claims.

What is claimed is:

1. A modular inflatable entertainment venue for use on a body of water comprising:

a substrate having an upper surface and a lower surface wherein said substrate further comprises at least one air chamber disposed between said upper surface and said lower surface;

a pedestal connected to the substrate for supporting a removable tabletop, the pedestal having a fastener for attaching the removable tabletop;

the removable tabletop removably attached to the pedestal by said fastener;

at least one aperture in the substrate defining a sitting area; and a netted footwell removably attached about a periphery of said at least one aperture and extending downward into the water.

2. The modular inflatable entertainment venue of claim 1 wherein the fastener on the pedestal comprises hook and loop fasteners.

3. The modular inflatable entertainment venue of claim 1 wherein the netted footwell is connected to the modular inflatable entertainment venue by hook and loop fasteners.

4. The modular inflatable entertainment venue of claim 1 further including a channel molded into the substrate.

5. The modular inflatable entertainment venue of claim 4 wherein a set of steps is disposed in the channel for ingress and egress to the modular inflatable entertainment venue.

6. The modular inflatable entertainment venue of claim 1 further including a back rest further defining a sitting area adjacent said at least one aperture.

7. The modular inflatable entertainment venue of claim 1 wherein said substrate includes body fasteners for connecting to a different modular inflatable apparatus.

8. The modular inflatable entertainment venue of claim 7 wherein the substrate further comprises a connection flap for connecting to a gap cap cover between the modular inflatable entertainment venue and said different modular inflatable apparatus.

9. The modular inflatable entertainment venue of claim 8 wherein the substrate further comprises cover fasteners for attaching a removable cover.

10. The modular inflatable entertainment venue of claim 1 further comprising a removable cover.

11. The modular inflatable entertainment venue of claim 1 wherein said removable tabletop further comprises wells for holding food and/or drinks.

12. The modular inflatable entertainment venue of claim 1 wherein the substrate further comprises ballast bags.

13. A modular inflatable entertainment venue for use on a body of water comprising:

a substrate having an upper surface and a lower surface wherein said substrate further comprises at least one air chamber disposed between said upper surface and said lower surface;

a pedestal connected to the substrate for supporting a removable tabletop, the pedestal having a hook and loop fastener for attaching the removable tabletop;

the removable tabletop removably attached to the pedestal by said hook and loop fastener;

at least one aperture in the substrate defining a sitting area; and a netted footwell removably attached about a periphery of said at least one aperture with hook and loop fasteners and extending downward into the water.

14. The modular inflatable entertainment venue of claim 13 wherein netted footwell includes a bottom.

15. The modular inflatable entertainment venue of claim 13 further including a channel molded into the substrate and wherein a set of steps is disposed in the channel for ingress and egress to the modular inflatable entertainment venue.

16. The modular inflatable entertainment venue of claim 13 further including a back rest further defining a sitting area adjacent said at least one aperture.

17. The modular inflatable entertainment venue of claim 13 wherein said substrate includes body fasteners for connecting to a different modular inflatable apparatus and a connection flap for connecting to a gap cap cover between the modular inflatable entertainment venue and said different modular inflatable apparatus.

18. The modular inflatable entertainment venue of claim 13 further comprising a removable cover attached to the modular inflatable entertainment venue by cover fasteners attached to the substrate.

19. The modular inflatable entertainment venue of claim 13 wherein said removable tabletop further comprises wells for holding food and/or drinks.

20. A modular inflatable entertainment venue for use on a body of water comprising:

a substrate having an upper surface and a lower surface wherein said substrate further comprises at least one air chamber disposed between said upper surface and said lower surface;

a pedestal connected to the substrate for supporting a removable tabletop, the pedestal having a hook and loop fastener for attaching the removable tabletop;

the removable tabletop removably attached to the pedestal by said hook and loop fastener;

at least one aperture in the substrate defining a sitting area;

a netted footwell having sides and a bottom removably attached about the periphery of said at least one aperture with hook and loop fasteners and extending downward into the water;

a channel molded into the substrate and wherein a set of steps is disposed in the channel for ingress and egress to the modular inflatable entertainment venue;

a back rest further defining a sitting area adjacent said at least one aperture;

body fasteners for connecting to a different modular inflatable apparatus;

a connection flap for connecting to a gap cap cover between the modular inflatable entertainment venue and said different modular inflatable apparatus;

a removable cover attached to the modular inflatable entertainment venue by cover fasteners attached to the substrate; and ballast bags attached to the substrate.

* * * * *